US007012218B2

(12) United States Patent
Flinn

(10) Patent No.: US 7,012,218 B2
(45) Date of Patent: Mar. 14, 2006

(54) TORTILLA CART WARMER

(76) Inventor: Gary L. Flinn, Rte. 2 Box 98, Lubbock, TX (US) 79415

( * ) Notice: Subject to any disclaimer, the term of this patent is extended or adjusted under 35 U.S.C. 154(b) by 0 days.

(21) Appl. No.: 10/827,567

(22) Filed: Apr. 19, 2004

(65) Prior Publication Data

US 2004/0226932 A1 Nov. 18, 2004

Related U.S. Application Data

(60) Provisional application No. 60/465,521, filed on Apr. 28, 2003.

(51) Int. Cl.
*A47J 36/24* (2006.01)

(52) U.S. Cl. ..... 219/400; 219/385; 219/214; 312/236; 222/146.5

(58) Field of Classification Search ..... 219/385, 219/386, 214, 400; 99/474, 476; 126/214; 312/236; 222/146.5
See application file for complete search history.

(56) References Cited

U.S. PATENT DOCUMENTS 2,279,484 A * 4/1942 Munshower ..... 62/251
2,836,039 A * 5/1958 Weber ..... 62/252
3,229,475 A * 1/1966 Balk et al. ..... 62/256
3,545,832 A * 12/1970 Levenback ..... 219/214
3,730,603 A 5/1973 Looms
4,608,776 A * 9/1986 Kooy ..... 312/236
4,608,835 A * 9/1986 Kooy ..... 62/255
4,923,681 A * 5/1990 Cox et al. ..... 219/400
5,964,512 A 10/1999 Borgen
6,111,224 A * 8/2000 Witt ..... 219/214
6,259,065 B1 * 7/2001 Hohler et al. ..... 219/400
6,438,909 B1 8/2002 Birch et al.

* cited by examiner

*Primary Examiner*—Joseph Pelham

(57) ABSTRACT

A warmed display fixture includes a housing enclosing a tree step display compartment and having an opening providing access thereunto. A three step panel divides the display compartment into an upper air well above the three step panel and a lower air well below the three step panel. The three step panel has ceramic tile on both horizontal and vertical risers. An air recirculation passageway in the housing has an inlet in the upper air well of the display compartment and an outlet in the lower air well. Heaters mounted under the horizontal steps and in air passageway provide heat. Fans circulate the warmed air through the air passage ways and into the upper air well of the display compartment.

6 Claims, 2 Drawing Sheets

TORTILLA CART WARMER

CROSS REFERENCE TO RELATED APPLICATIONS

This application claims the benefit of PPA Ser. No. 60/465,521, filed Apr. 28, 2003 by the present inventor.

BACKGROUND OF THE INVENTION—FIELD OF THE INVENTION

This invention relates to display fixtures. More particularly, this invention relates to a method and means for warming packaged tortillas displayed in such fixtures.

BACKGROUND OF THE INVENTION

Grocery stores and supermarkets, particularly bakery departments, stock baked products on display fixtures. These fixtures are usually constructed of wood, composites, or metal and are open to the store environment. One shortcoming of this type of display is that baked products cool to the temperature of the store environment, usually 75 degrees, within minutes of placement on these open fixtures. One of the main emphasis of supermarkets and grocery stores is freshness. Heated products, especially warm tortillas convey this idea of "right out of the oven" freshness.

BACKGROUND OF THE INVENTION—OBJECTS AND ADVANTAGES

Therefore, a primary object of the present invention is the provision of a means and method for maintaining warm baked products in these fixtures A further object of this invention is the displaying of baked products at a temperature above surrounding temperature.

A further object of this invention is the provision of a lower front panel and higher back panel to facilitate the normal rise of heated air from front to back.

A further object of this invention is the provision of a heated display fixture having a three-step panel extending across the display compartment so as to form an upper air well and a lower air well.

A further object of this invention is the provision of a heated display fixture wherein heated air flows from lower air well to upper air well over the three step panel to form a warm air curtain.

A further object of this invention is the provision of a three step panel fabricated of metal pans and ceramic tile to provide an heat sink.

A further object of this invention is the provision of a warmed display fixture, which is simple in construction, economical, and durable in use.

These and other objects will be apparent to one skilled in the art from the drawings, description, and claims, which follow.

SUMMARY

The present invention achieves the above objects by providing a warmed display fixture for displaying tortillas and baked products. The warmed display fixture includes a housing enclosing a display compartment and having an opening providing access thereunto. The display compartment has an upper portion, a lower portion, a front portion, and a rear portion. A three-step panel divides the display compartment into an upper air well above the three-step panel and a lower air well below the three-step panel. The three step panel has three horizontal metal pans and two vertical riser pans with ¼" ceramic tiles adhered to pans to provide a heat sink. This three-step panel also provides the surface for holding and displaying packaged products. Three heated rods are mounted to the bottom of the horizontal pans.

An air circulation passageway in the housing has an inlet in the upper air well of the display compartment, a plenum located at the rear of display compartment, and an outlet in the lower air well. A finned heater is mounted in the plenum below the inlet in the upper air well. Fans circulate the warmed air from the lower air well into the upper air well of the display compartment.

The configuration of the present invention encourages the warmed air to ascend from the lower front outlet of the lower air well to the upper rear inlet of the upper air well thus creating an air curtain surrounding the product. The three-step panel with heated ceramic tiles provides the product with heat from underneath the product.

DRAWINGS—FIGURES

DRAWINGS—REFERENCE NUMERALS

| | |
|---|---|
| 10 display fixture | 12 front panel |
| 14 bottom panel | 16 back panel |
| 18 top panel | 20 side panels |
| 22 transparent panels | 24 display compartment |
| 26 three-step panel | 26A top step |
| 26B middle step | 26C bottom step |
| 27A middle riser | 27B bottom riser |
| 28 top metal riser | 30 upper air passageway (inlet) |
| 32 rear air passageway (plenum) | 34 upper air well |
| 35 lower air well | 36 metal skin |
| 38 insulation | 40 heater rod |
| 42 coil heater | 44 fan motors |
| 46 lower air passageway (outlet) | 48 bottom frame |
| 50 locking castors | |

DETAILED DESCRIPTION—FIGS. 1 AND 2—PREFERRED EMBODIMENT

Figure 1:
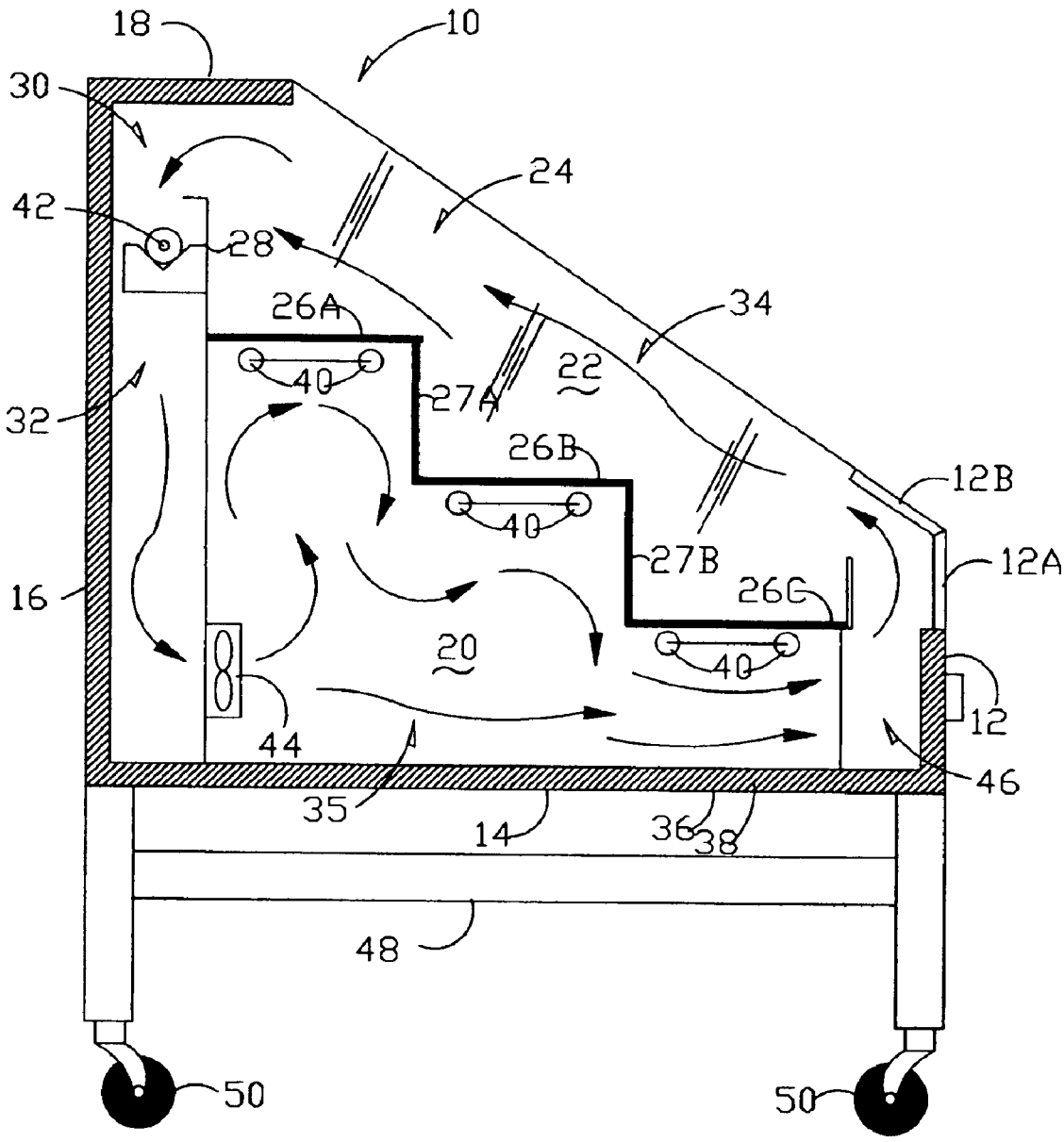
FIG. 1 is a vertical side view of the display fixture of the present invention.
Figure 2:
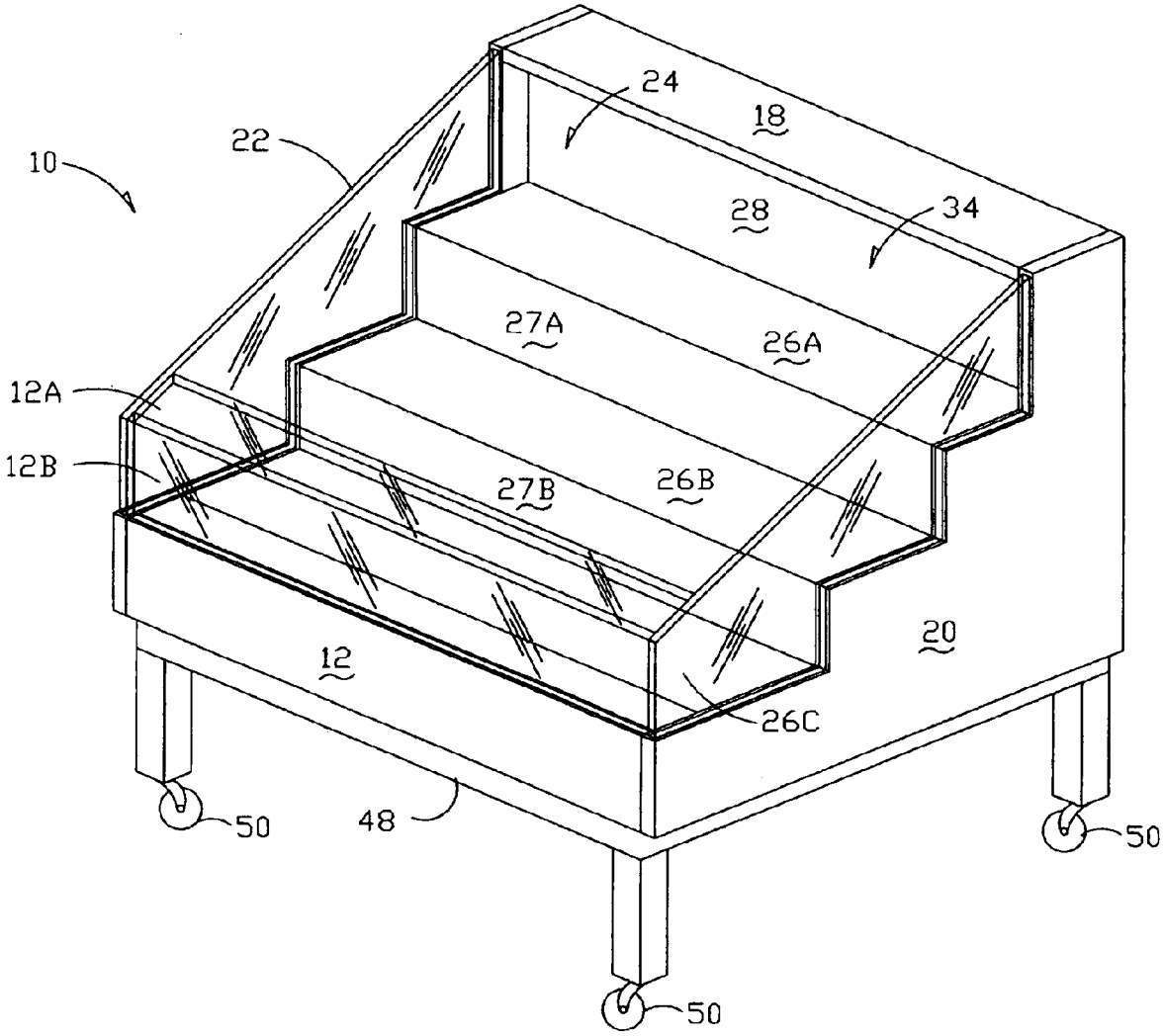
FIG. 2 is a perspective view of the display fixture of the present invention.

In the drawings and the descriptions, which follow, the warmed display fixture of the present invention is designated with reference numeral 10. Referring to FIG. 1, the warmed display fixture 10 is 36 inches from back to front and 40 inches wide. The front of display fixture 10 includes a front panel 12, 7 inches high from the bottom panel 14. The back panel 16 of the display fixture 10 is 30 inches in height. A top panel 18 extends horizontally 7 inches from the back panel 16. The side panels 20 of the display fixture 10 is 36 inches from front panel 12 to back panel 16 is 30 inches in height. The side panels 20 stair steps down from the top of forward edge of top panel 18 down to front panel 12. The upper portions 12A and 12B of the panel 12 is constructed of 7 inch high and 4 inch high respectively of clear glass, Plexiglas, or similar transparent material to enhance the visibility into the display compartment 24. Likewise, the upper portions of side panels 20 include glass, Plexiglas, or other suitably transparent panels. Referring to FIG. 2, the transparent panels 22 extend from the forward edge of top panel 18 down to front left side and the front right side of front panel 12. The glass panels form the final portions of the display fixture 10 and define an opening therein which provides access to the display compartment 24. As seen in FIG. 1, the back 16, bottom 14, front 12, and top 18, comprises an insulated panel having a layer of insulation 38 sandwiched between two spaced sheet metal skins 36.

Referring to FIG. 2, a stair step panel 26 is mounted in display fixture 10. The stair step panel 26 consists of three horizontal steps and two riser steps constructed of metal pans with 4 inch ceramic tile adhered to pans. The three horizontal steps 26*a*, 26*b*, 26*c*, each of 9 inch depth extend between sides 20 of display fixture 10. Two risers 27*a* and 27*b* are attached to the front of the upper horizontal steps 26*a* and 26*b*. The risers, 27*a* and 27*b*, are each 6 inches in height and extend the full 40 inches between sides 20. As illustrated in FIG. 1, a top metal riser 28 is faced 4 inches from the inside of back panel 16 of display fixture 10 and extending from bottom panel 14 up to 6 inches above top step 26*a*. Top metal riser 28 stops 4 inches below inside of top panel 18 of display fixture 10. This opening is the upper air passageway 30 of display fixture 10. The bottom of each step 26*a*, 26*b*, and 26*c* have a heater rod 40 attached below it. The heater has paired rod bars extending along the bottom of step 26*a*, 26*b*, and 26*c*. A coil heater 42 is mounted on the inside of top metal riser 28. Two fans 44 are mounted on the front of top metal riser 28 in the lower air well 35. The fans 44 pull air downward from the upper air passageway 30 through plenum 32 to lower air well 35 to lower air passageway 46 located inside of front panel 12 picking up heat created by the electric rod heaters 40 beneath each step 26*a*, 26*b*, and 26*c* and coil heater 42 located behind top metal riser 28.

For mobility, the display fixture 10 is mounted on bottom frame 48. Four three inch locking castors 50 are mounted on the four legs of the bottom frame.

OPERATION

In operation, the fans 44 draw air from the upper air well 34 through upper air passageway 30 over the coil heater 42 down through the plenum 32 to the lower air well 35 under the three step panel 26 picking up residual heat from the rod heaters 40 mounted underneath the steps 26*a*, 26*b*, and 26*c*. From there the air is forced to the lower air passageway 46 and over the top of the three step panel 26 and back to the upper air passageway 30. Thereafter, the cycle is repeated to maintain the desired heating effect.

Therefore, it may been seen that the tortillas or baked products which are placed upon the ceramic tiled steps 26*a*, 26*b*, and 26*c* are warmed by rod heaters 40 located underneath each step and by the circulation of warm air over the surface of them. Also with the intake 30 being at the top of the three step panel 26, much of the warm air that passes over the tortillas will be drawn upward and thus recycled.

CONCLUSION, RAMIFICATION, AND SCOPE

The present invention provides for the holding of tortillas and baked products at warmer temperatures than has been possible heretofore. The warm air curtain and step heaters warm the tortillas or baked products. Therefore, it can be seen that the present invention accomplishes its stated objectives.

It will be appreciated that the present invention can take many forms and embodiments. The true essence and spirit of the invention are defined in the appended claims, and it is not intended that the embodiment of the invention presented herein should limit the scope thereof.

What is claimed is:

1. A warmed display fixture comprising:

a housing comprising a low font wall, a back wall higher than the front wall, a bottom wall, a top wall, and end walls forming a display compartment, said housing having an opening providing access to the display compartment from outside the housing;

a stepped panel within said display compartment dividing the compartment into an upper air well above said stepped panel and a lower air well below said stepped panel;

an air passageway having an inlet opening above said stepped panel and an outlet opening below said stepped panel, the front, back, bottom, and end walls, and the stepped panel forming the passageway between said inlet and outlet openings;

said stepped panel comprising horizontal steps and risers therebetween;

said stepped panel also comprising heaters mounted beneath the horizontal steps;

a coil heater arid a least one fan to circulate air over said coil heater, in said air inlet opening, under said stepped panel, and out said outlet opening.

2. The warmed display fixture as recited in claim 1, wherein said stepped panel comprises three steps.

3. The warmed display fixture as recited in claim 1, wherein said stepped panel is clad in ceramic tiles.

4. The warmed display fixture as recited in claim 1, further comprising plurality of fans.

5. The warmed display fixture as recited in claim 1, wherein the coil heater is positioned adjacent said inlet opening.

6. The warmed display fixture as recited in claim 1, wherein the coil heater is positioned adjacent said outlet opening.

* * * * *